US006435268B1

(12) United States Patent
Bhatti et al.

(10) Patent No.: US 6,435,268 B1
(45) Date of Patent: Aug. 20, 2002

(54) EVAPORATOR WITH IMPROVED CONDENSATE DRAINAGE

(75) Inventors: Mohinder Singh Bhatti, Amherst; Shrikant M. Joshi, Williamsville; Steven R. Falta, Ransomville, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/852,517

(22) Filed: May 10, 2001

(51) Int. Cl.[7] ..... F28D 1/02

(52) U.S. Cl. ..... 165/111; 165/152; 165/153; 165/913

(58) Field of Search ..... 165/111, 152, 165/913, 153; 62/515

(56) References Cited

U.S. PATENT DOCUMENTS

| | | | | |
|---|---|---|---|---|
| 4,350,025 A | * | 9/1982 | Izumi | 62/515 |
| 4,621,685 A | | 11/1986 | Nozawa | 165/111 |
| 4,926,932 A | | 5/1990 | Ohara et al. | 165/111 |
| 4,966,230 A | | 10/1990 | Hughes et al. | 165/150 |
| 6,216,773 B1 | | 4/2001 | Falta | 165/153 |

FOREIGN PATENT DOCUMENTS

| | | | | |
|---|---|---|---|---|
| JP | 60-253792 | * | 12/1985 | 165/913 |
| JP | 5-60481 | * | 3/1993 | 165/913 |
| JP | 5-180533 | * | 7/1993 | 165/913 |
| JP | 06066458 | | 3/1994 | 165/913 |
| JP | 6-123588 | * | 5/1994 | 165/913 |
| JP | 08035742 | | 2/1996 | |

* cited by examiner

*Primary Examiner*—Leonard Leo
(74) *Attorney, Agent, or Firm*—Patrick M. Griffin

(57) ABSTRACT

An evaporator used in a vehicle air conditioner has vertical plates with a hybrid corrugated fin between the plates. The leading section of the fin as horizontally oriented corrugations, as is normal, while the trailing section has vertically oriented corrugations. Air passes through louvers in the vertical corrugations, and their vertical orientation aids in water drainage.

6 Claims, 3 Drawing Sheets

EVAPORATOR WITH IMPROVED CONDENSATE DRAINAGE

TECHNICAL FIELD

This invention relates to air conditioning system evaporators in general, and specifically to a novel air fin arrangement therefor.

BACKGROUND OF THE INVENTION

Vehicle air conditioning evaporators, because of their placement near the interior of the vehicle, are subject to having the film of water that naturally condenses thereon blown out and into the vehicle interior by the forced air stream that is blown through the evaporator, a phenomenon generally referred to as spitting. Typical evaporator cores consist of a vertically oriented plurality of tubes or plates, through which cold refrigerant is pumped, and between which corrugated air fins or "air centers" are brazed, in close thermal contact. The air centers are cooled by contact with the cold tubes or plates, and warm, humid air is cooled as it is blown over the corrugated fins. Water naturally condenses on both the outside of the tubes/plates and the fins. It is relatively easy to promote drainage of condensed water off of the tube surfaces, since they are vertically oriented, and drainage channels can be stamped or formed into the surface thereof if desired.

Promoting drainage from the corrugated fins is more difficult. Since the corrugations are oriented substantially horizontally, so as not to block the horizontal air flow thereover, the fin walls inevitably block vertical downward flow of condensed water. The corrugated fin walls typically have louver patterns cut through them, to break up the otherwise laminar airflow, and these provide some drainage vertically through the fin walls, but louver cuts are quite thin, and the surface tension of the water film resists rapid drainage through such thin openings. Louvers also are typically not cut all the way to the fold or crest of the fin walls, so condensate will naturally pond in the horizontal troughs created by the horizontal fins brazed to the vertical tube surfaces. It has been proposed to drain these troughs by cutting special drainage holes through the fin wall folds, near the areas of contact with the tube surfaces. This inevitably reduces fin cooling efficiency, by reducing the conductive contact between tube and fin, and makes the fin more difficult to produce. Other proposed schemes include stacking two layers of corrugated fins between the tubes, each layer separated from the other by either a porous sheet, or by a thin corrugated sheet in which the corrugations are arranged 90 degrees to the fin walls, creating a less impeded vertical drainage path. This requires an additional part, and creates a core that is more difficult to stack and braze, because of the double layer of air fins. Either shorter air fins have to be used, or the refrigerant tubes have to be spaced twice as far apart, which would seriously reduce efficiency. Such a design would also do nothing, in and of itself, to drain the horizontal troughs at the tube outer surfaces.

When standard air centers are used, with no special drainage enhancing features beyond the existing louvers, the standard means to reduce so called "spitting" of undrained condensed water out of the evaporator core is the provision of a screen over the downstream face of the core. This adds expense and increases air pressure drop, but is commonly used.

SUMMARY OF THE INVENTION

The subject invention promotes drainage from the air centers or fins not by altering the design of the fin per se, but by a unique combination of orientations of the fins between the plates. Nothing is changed in the fin's basic design, or in the basic manufacture and assembly of the core itself.

In the preferred embodiment disclosed, pairs of vertically oriented evaporator plates are spaced apart a standard distance. Rather than a single, continuous corrugated fin between each adjacent pair of plates, a compound arrangement of a leading fin and trailing fin is used, of equal, standard height and conventional configuration, but with 90 degree opposed orientations. Specifically, the fin walls of the leading fin are oriented horizontally, as is conventional, but the leading fin covers less than half of the depth of the core, about one third as disclosed. The remainder of the core comprises a similarly shaped fin oriented 90 degrees opposite.

Air entering the leading face of the core travels between the fin corrugations conventionally, parallel to the fin walls. While there is no direct vertical drainage path out of the leading fin, condensation is not heavy in that area, since the air has not yet cooled enough, for the most part, to reach the dew (condensation) point. Once through the leading fin, the air encounters the vertically oriented trailing fin and the vertically oriented fin walls thereof. Resistance to air flow is higher now, but not completely blocked, since air can still flow through the louver patterns of the successively encountered vertical fin walls. The air is sufficiently cooled by the time it passes through the trailing fins to condense the entrained water, which can now flow easily downwardly under the force of gravity, out of the core. The folds of the trailing fin, being vertically oriented, now create vertical drainage channels, rather than non draining horizontal troughs. Since the fins are standard design and standard height, differing only in their compound orientation between the tubes, very little change to the standard core assembly and construction is needed.

BRIEF DESCRIPTION OF THE DRAWINGS

These and other features will appear from the following written description, and from the drawings, in which.

DESCRIPTION OF THE PREFERRED EMBODIMENT

Figure 1:
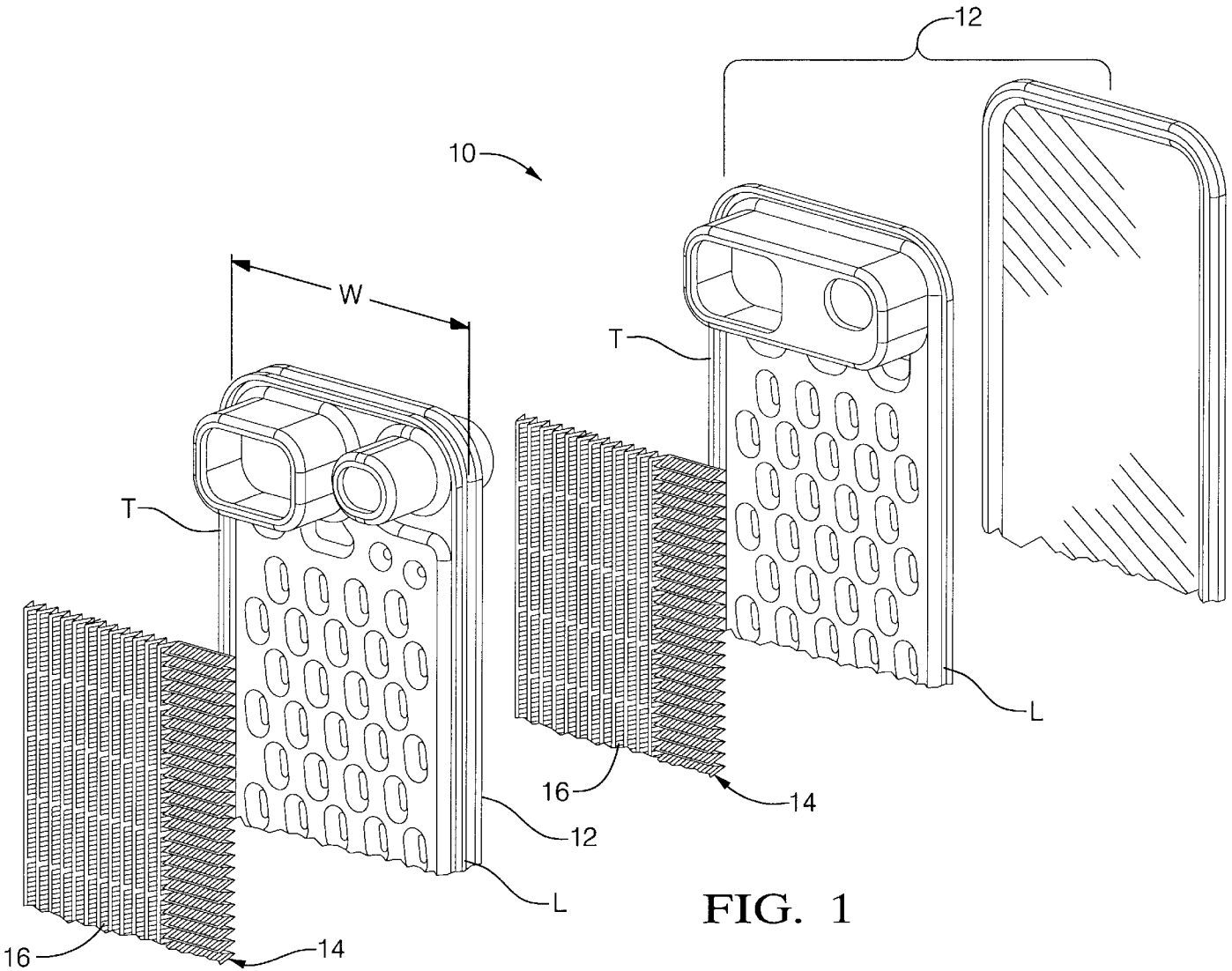
FIG. 1 is an exploded perspective view of a portion of an evaporator core incorporating the compound fin arrangement of the invention.

Referring first to FIG. 1, an evaporator core indicated generally at 10 includes a regularly spaced series of conventional refrigerant tubes, one of which is indicated generally at 12. Tube 12 is the type that is formed of two halves or plates brazed together around the edges, with an internal bump pattern that provides structural strength, and serves to turbulate the internal refrigerant flow. Other tube designs could have internal webs or fins, or could be extruded as one piece, or any other design that provided basically flat outer surfaces. Regardless of the actual tube construction, tubes like 12 are preferably vertically oriented, or nearly so, so that air flows along the predetermined width W thereof, from leading edge L to trailing edge T. The vertical orientation is an easy means of providing, downward, gravity induced drainage of the film of water that naturally condenses on the tube outer surfaces. However, the primary condensation problem in evaporators is on the air fins or centers that are brazed between the tubes 12, since they present a great deal more surface area than the tubes 12, surface area that is convoluted and does not drain nearly so readily. The retention of condensation on the air fins can greatly reduce air flow, increase air flow pressure drop and also reduce air to fin surface conduction, all of which negatively effect efficiency.

Figure 3:
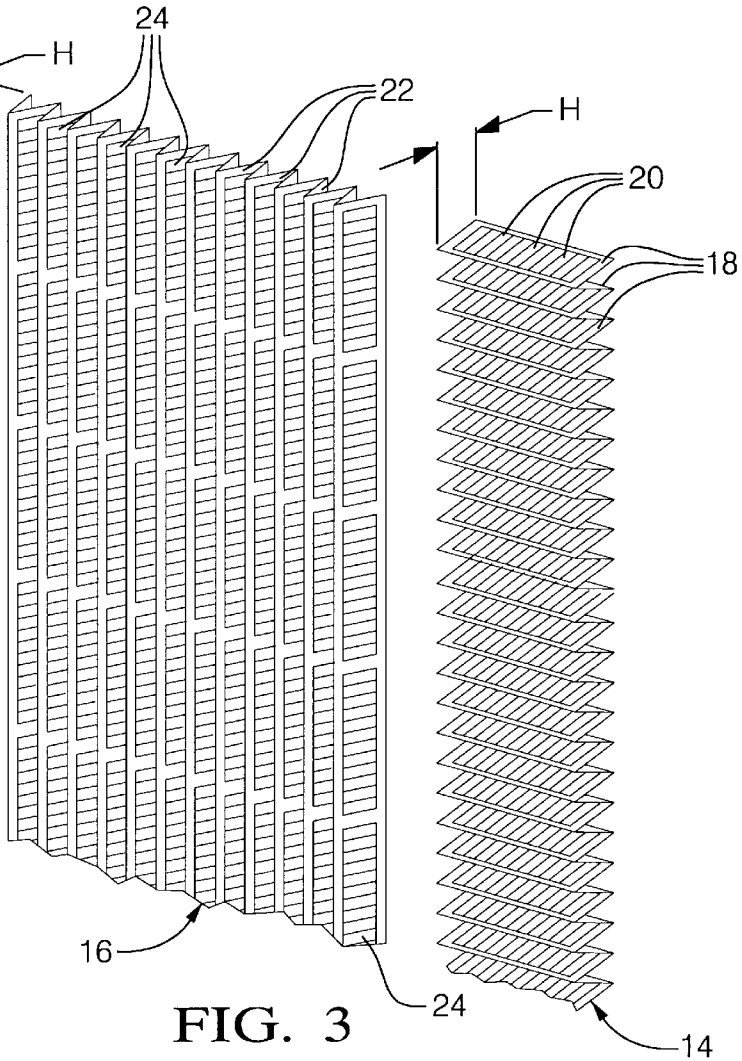
FIG. 3 is a view similar to FIG. 2, but showing the two parts of the compound fin arrangement separated.
Figure 2:
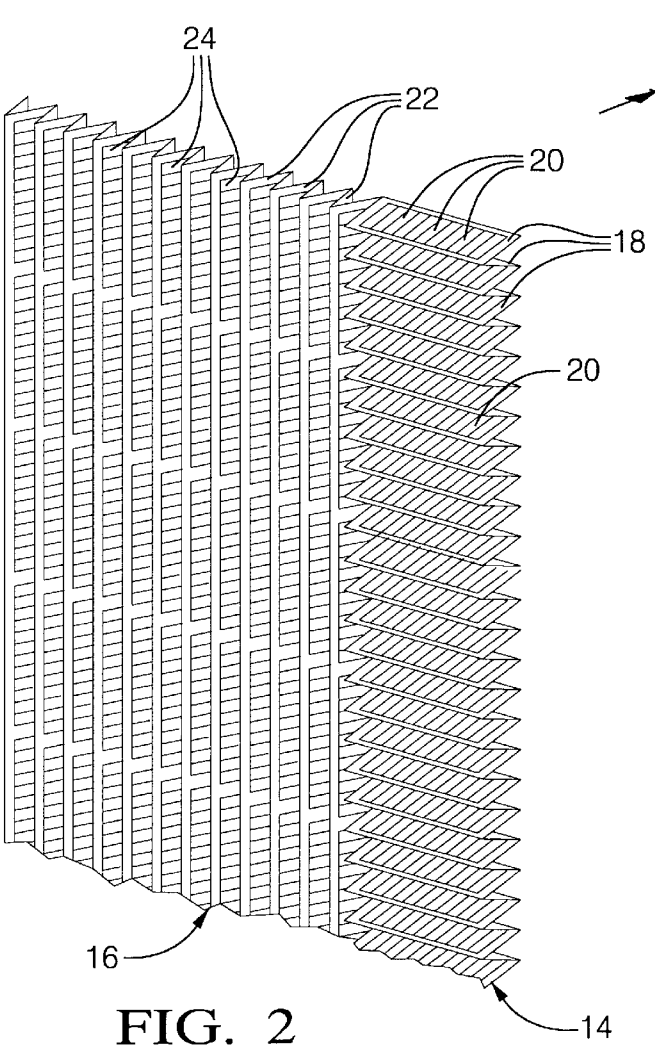
FIG. 2 is an enlarged perspective view of a portion of the compound fin alone.

Referring to FIGS. 1, 2 and 3, the subject invention enhances condensation drainage out of and off of the air fins or air centers by using a fin arrangement in which a pair of side by side air centers of basically conventional size and design are arranged in a novel compound configuration. A leading fin, indicated generally at 14, and a trailing fin, indicated generally at 16, are oriented respectively horizontally and vertically between each pair of tubes 12. The terms "leading" and "trailing" indicate that the leading fin 14 begins at the tube leading edge L, and the adjacent trailing fin 16 begins where it ends, finishing at the tube trailing edge T. Leading fin 14 is conventional in every aspect except total width, as it would normally run the full width W of the tubes 12. As disclosed, its width is approximately only a third of that width. Other than its shorter width, leading fin 14 has the standard corrugated design, with folded fin walls 18 forming an acute angle or V shape relative to one another, joined at alternating integral folds or crests. The crests are rounded slightly, not sharp edged, and in alternate designs might be more U shaped, or even squared off, putting the fin walls 18 in a more parallel, rather than V shaped configuration. Regardless, the fin would still have the basic corrugated shaped. The height H of the leading fin 14, as measured between the crests or folds, is equal to or just slightly greater than the desired spacing between the opposed, outer surfaces of pairs of adjacent tubes 12. Therefore, as the core is built up of successive pairs of tubes 12 and fins, there is solid contact between the fin crests and the outer surfaces of the tubes 12, to facilitate brazing. Standard narrow louvers 20 are cut from and bent out of the fin walls 18, extending through and to either side of the plane of the fin wall 18 at a slight angle, so as to leave a pattern of narrow openings through wall 18. Air flow parallel to the fin wall 18 that might otherwise become laminar and thus inefficient at heat exchange with the wall 18 is broken up and sent "through" the fin wall 18, in addition to flowing along it. This extra component of air flow motion enhances efficiency, and is a standard practice. It will be noted that, as is typical, the louvers 20 are not as long as the fin wall 18 is wide, leaving an area along the length of the fold or crest that is smooth and uninterrupted. This is a result of the fin manufacturing technique, and is recognized as being undesirable from an air flow standpoint, if inevitable, as it creates an area where air can "by pass" the louvers 20.

Still referring to FIGS. 1, 2 and 3, trailing fin 16 is similar in basic design to leading fin 14, being similarly corrugated with fin walls 22 joined at integral folds or crests. The "height" H, or distance between folds, would be equal to that of leading fin 14, as well. The most significant distinction between the two fins 14 and 16 is their orientation relative to one another and to the air flow, with trailing fin 16 being substantially perpendicular to both leading fin 14 and to the direction of air flow. Consequently, its length is equal to substantially the full length of the inner surfaces of the tubes 12, and the fin walls 22 themselves are much longer than normal, as they would conventionally be only as long as the tubes 12 were wide. The total number of fin walls 22, however, is consequently far fewer. This 90 degree turned orientation of trailing fin 16 is counter intuitive, to be sure, since it puts the fin walls 22 in a position to block the air flow. Airflow can still pass through louvers 24 cut through the fin walls 22, however. The louvers 24 would not be serving the same purpose as the louvers 20 in the leading fin 14, since laminar air flow build up would not be an issue on vertical fin walls 22. Instead, the louvers 24 would be providing the only air flow path, not merely providing an extra component to the air flow. Given their different purpose, it would be possible to give the trailing fin louvers 24 a steeper angle, to allow air to pass through more easily, and also possible to decrease the density of the fin, that is, to provide fewer fin walls 22 per unit length than would be typical. Such changes would be relatively simple to make, while still maintaining the same basic fin design and manufacturing process. However, the length of louvers 24 should still bear the standard relation to the width of fin wall noted above, for reasons noted below. Since both fins 14 and 16 have the same height, they would be stacked between the facing pairs of tubes 12 just as conventional, non compound fins would, and brazed the same way. The only significant difference would be the necessity to stack two fins between each pair of tubes 12, but since they are stacked side by side, rather than on top of one another, that change would be essentially transparent to the assembler. Conventional stacking apparatus could be used, and a conventional number of tubes 12 would exist within the space available.

Figure 4:
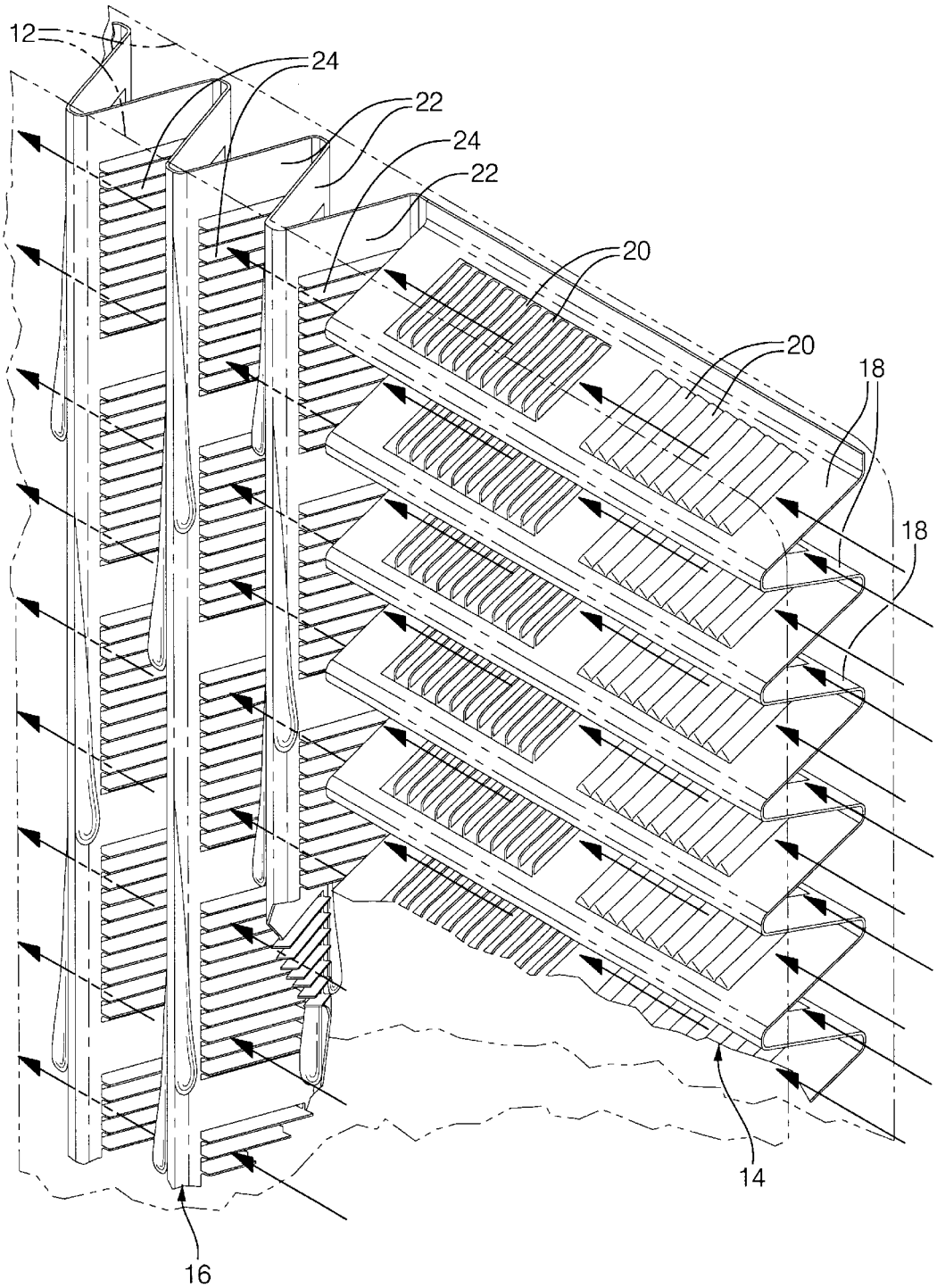
FIG. 4 is a view similar to FIG. 2, showing the air flow and drainage of condensed water.

Referring next to FIG. 4, the operation of evaporator 10, once assembled and brazed, is illustrated. Warm, humid air is blown in the direction shown, perpendicular to the generally vertical tubes 12. The air flows over the leading fin 14 first, generally parallel to and between its fin walls 18, broken up somewhat by the louvers 20, but otherwise unimpeded. Because the air has not yet reached its dew point, for the most part, there is little or no water condensation on the leading fin 14, nor on that portion of the outer surface of the tubes 12 that corresponds to the leading fin 14. When the airflow reaches the trailing fin 16, its only available flow path through the perpendicular fin walls 22 is through the openings created by the louvers 24. This is a more restrictive flow path than the flow through the leading fin 14, and creates more pressure drop. The increased pressure drop is worth the attendant advantage, however. By the time it flows through the more restrictive trailing fin 16, the air temperature has reached the dew point, and condensation occurs. The vertically oriented fin walls 22, while they restrict air flow more, do not block water drainage under the force of gravity. The vertically oriented folds between fin walls 22 provide ideal drainage channels, both on their inner surfaces, where they converge in a general V or U shape, and on their outer surface brazed interface to the outer surfaces of the tubes 12. This is clearly visible in FIG. 4, where the position of the outer surfaces of tubes 12 is indicated by the dotted planes. Thus, the fact that the louvers 24 do not run the full width of the fin walls 22 becomes an advantage. No extra drainage channels need be created in the outer surfaces of the tubes 12, nor extra drainage holes in the fin folds. With no extra drainage holes needed in the fin walls 22, and no grooves in the tubes 12, there is continuous conductive contact everywhere between the crests joining the fin walls 22 and the outer surfaces of tubes 12, as well. While the air flow is more restrictied through the vertically oriented trailing fin walls 22, another advantage is that the so called "spitting" of condensed water that occurs with the rapid and easy air flow through conventional horizontally oriented fin walls is reduced or prevented. The vertically oriented trailing fin 16 acts as its own "anti-spitting" screen, in effect, eliminating the need for the type of screen noted above.

Variations in the disclosed embodiment could be made. Fundamentally, any compound corrugated fin, a leading fin horizontally oriented, and a trailing fin oriented 90 degrees transverse to it with a pattern of openings cut through the trailing fin walls, would work. Such openings need not necessarily be louvers per se, but any pattern of openings that leaves the fin wall sufficiently open to pass the air flow therethrough without excessive pressure drop. Ideally, such openings through the fin wall should leave the fin walls uninterrupted near the folds between fin walls, so as to leave uninterrupted the vertical drain channels that the vertical folds provide. This is exactly the opposite of drain holes cut through conventionally oriented horizontal fins, which are cut directly through the fold. As noted, conventional louver patterns typically do not reach all the way to the fold between fin walls, and therefore serve well both to provide air passage through the fin wall and not impede drainage down the folds between fin walls. The leading fin 14 theoretically need not have any louvers, either to provide condensate drainage (since significant condensate will not occur on it), or to provide air passage through the fin walls. However, louvered fin walls, in conventionally, horizontally oriented fins are more efficient, and part of the practical advantage of the invention is in using existing fin designs, altered only as to their relative orientation. The trailing fin 16 disclosed, being a single, integral member as disclosed, is, as noted above, substantially longer than normal ("wider" than normal, if it were it horizontally oriented). This would require a larger than normal corrugation tool or apparatus in order to make it in one piece. However, it, too, could be built up in compound fashion out of several normal length (normal width) pieces, laid end to end, effectively creating a single long fin. The drainage troughs so created would have seams or "cracks" at the interfaces, but would still drain. Therefore, it will be understood that it is not intended to limit the invention to just the embodiment disclosed.

What is claimed:

1. In an air conditioning evaporator core having generally vertically oriented, spaced pairs of tubes of predetermined width measured between leading and trailing edges thereof, through which refrigerant flows, and over which humid, warm air is blown, substantially along the width of said tubes, and is cooled sufficiently before reaching said tube trailing edge to condense water therefrom, an air cooling fin arrangement, comprising, a leading fin in conductive contact between said pairs of tubes and located substantially flush to said tube leading edge, said leading fin having a series of corrugated fin walls joined to one another at integral folds and oriented with said fin walls and folds generally horizontal, the width of said leading fin, measured in the direction of air flow, being sufficiently less than the total width of said tubes that substantially little condensation from said humid air flow will occur on said leading fin, and a trailing fin in conductive contact between said pairs of tubes and located adjacent to said leading fin and substantially flush to said tube trailing edge, said trailing fin having a series of corrugated fin walls joined to one another at integral folds and oriented with said fin walls and folds generally vertical, each of said trailing fin walls also having a pattern of openings therethrough of sufficient total area to allow air that has passed through said leading fin to flow through successively through said vertically oriented fin walls, whereby, air that has passed through said leading fin will flow over and through said trailing fin vertically oriented walls, and water that condenses on said trailing fin walls will drain freely downwardly along said walls and the folds formed by said walls.

2. An air cooling fin arrangement according to claim 1, further characterized in that said trailing fin wall pattern of openings is a louver pattern.

3. An air cooling fin arrangement according to claim 1, further characterized in that said trailing fin walls pattern of openings does not intrude into said folds between fin walls.

4. An air cooling fin arrangement according to claim 2, further characterized in that said louver pattern does not intrude into said folds between fin walls.

5. An air cooling fin arrangement according to claim 2, further characterized in that said leading fin walls also have a louver pattern.

6. An air cooling fin arrangement according to claim 1, further characterized in that said trailing fin is a single, integral structure.

* * * * *